US005822802A

United States Patent [19]

Chou

[11] Patent Number: 5,822,802

[45] Date of Patent: Oct. 20, 1998

[54] HOSPITAL TROUSERS FOR PATIENTS

[75] Inventor: Chao-Mu Chou, Taipei, Taiwan

[73] Assignees: Chia-Tein Chou, Taipei; Shiu-Yin Cheng, Tao Yuan, both of Taiwan

[21] Appl. No.: 556,531

[22] Filed: Nov. 13, 1995

[51] Int. Cl.[6] ..... A41D 1/06

[52] U.S. Cl. ..... 2/227; 2/235

[58] Field of Search ..... 2/227, 228, 79, 2/83, 219, 220, 234, 235, 236, 237, 238, 270, 114, DIG. 1, 69

[56] References Cited

U.S. PATENT DOCUMENTS 974,981 11/1910 Lee ..... 2/114
2,663,873 12/1953 Stern ..... 2/83
5,033,126 7/1991 Wruck et al. ..... 2/227

FOREIGN PATENT DOCUMENTS 303253 11/1954 Switzerland ..... 2/227
2027330 2/1980 United Kingdom ..... 2/227

*Primary Examiner*—Gloria Hale
*Attorney, Agent, or Firm*—Bucknam and Archer

[57] ABSTRACT

Trousers for patients include a waist portion and a pair of legs. The waist portion has tying elements and at least one of the legs has a slit formed in its front side and running lengthwise of the leg. A fastening device is provided at the slit and consists of stops, pawls and slides disposed at both ends thereof in an opposite relationship.

1 Claim, 3 Drawing Sheets

HOSPITAL TROUSERS FOR PATIENTS

BACKGROUND OF THE INVENTION (a) Field of the Invention

The present invention relates generally to a lower garment for patients, and more particularly to a pair of trousers for in-patients, which is nice in appearance and will not obstruct medical examination or treatment on the patients.

(b) Description of the Prior Art

Although there have been considerable improvements on medical technologies and apparatuses, little effort has been made on the design of patients' wear. Conventional patients' wear is usually inconvenient and not presentable, and will obstruct the routine medical examination of treatment.

The inventor of the present invention has obtained two patents for providing upper garments for patients, but which are intended for patients in general and those having difficulty moving their upper bodies.

SUMMARY OF THE INVENTION

A primary object of the present invention is to provide a pair of trousers for in-patients especially those having difficulty moving their lower limbs or receiving medical treatment on their lower limbs.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
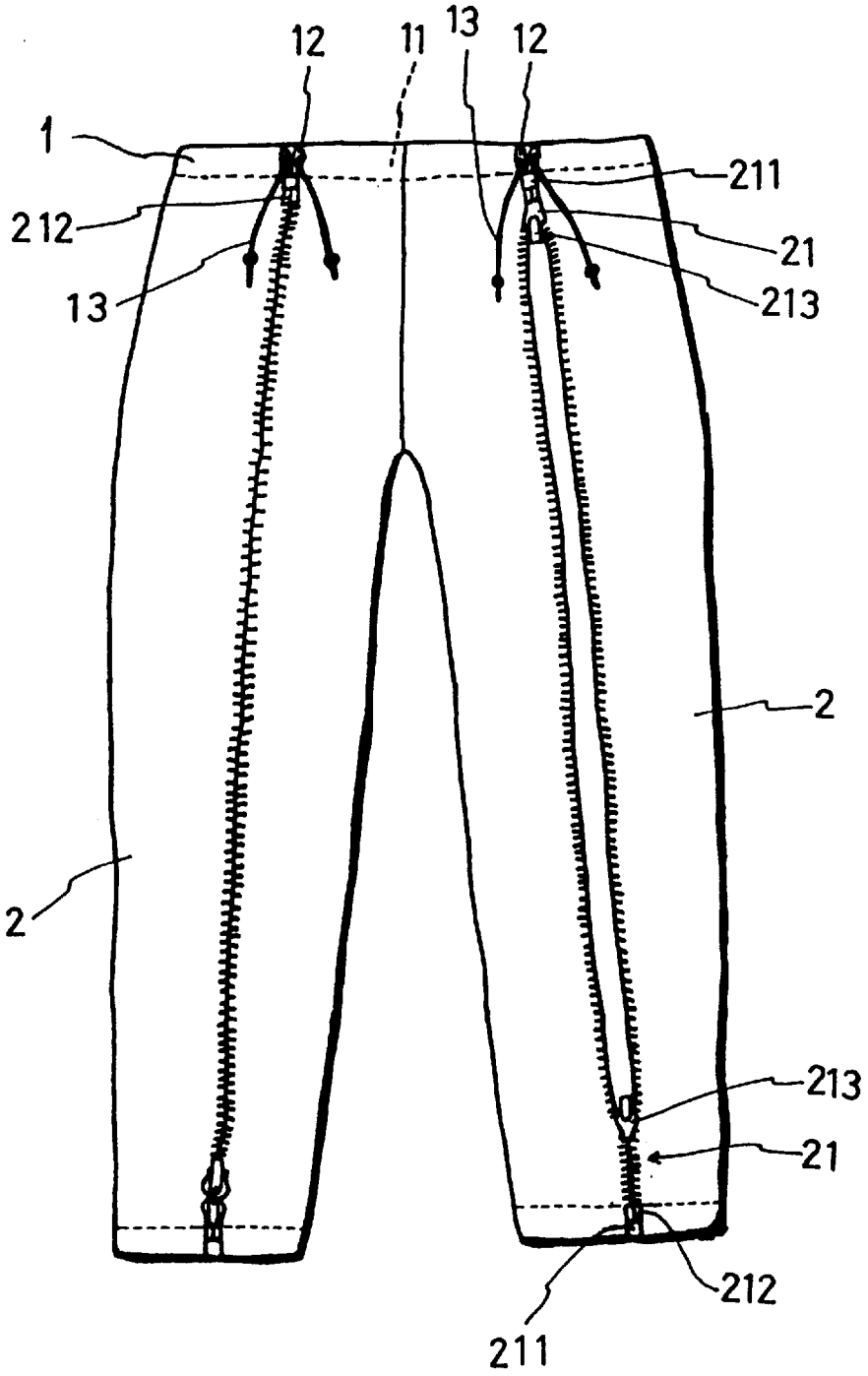
FIG. 1 is a perspective schematic view of the trousers according to the present invention.

As shown in the drawings, the trousers for patients according to the present invention basically comprises a waist portion 1 and two legs 2. As in the prior art, the waist portion 1 is folded inwardly to form a string hole 11. The waist portion 1 according to the present invention is characterized in having two openings 12 formed at either side thereof at positions matching two fastening devices 21, which will be described in detail below. Strings 13 are passed through the string hole 11 with their both ends coming out of the openings 12 so that they may be tied.

The design of the legs 2 is well known in the art and will not be repeated herein. The legs 2 according to the present invention are characterized in that at least one of the legs 2 has a slit formed in its front side which runs lengthwise of the leg 2 from the opening 12 at the waist portion 1 to a bottom end thereof. In this preferred embodiment, a slit is formed in both of the legs 2 and a pair of fastening devices 21 are respectively provided at the corresponding slits. Each fastening device 21 consists of two sets of bottom stop 211 and pawl 212 disposed oppositely at either end thereof. Two slides 213 are also respectively provided at both ends thereof in an opposite relationship, such that when the slides 213 of the fastening device 21 on one of the legs 2 are pulled away from each other towards its corresponding bottom stop 211 and pawl 212, the leg 2 is opened. Conversely, when the slides 213 are pulled towards each other until they are in contact, the leg 2 is closed completely.

Figure 2:
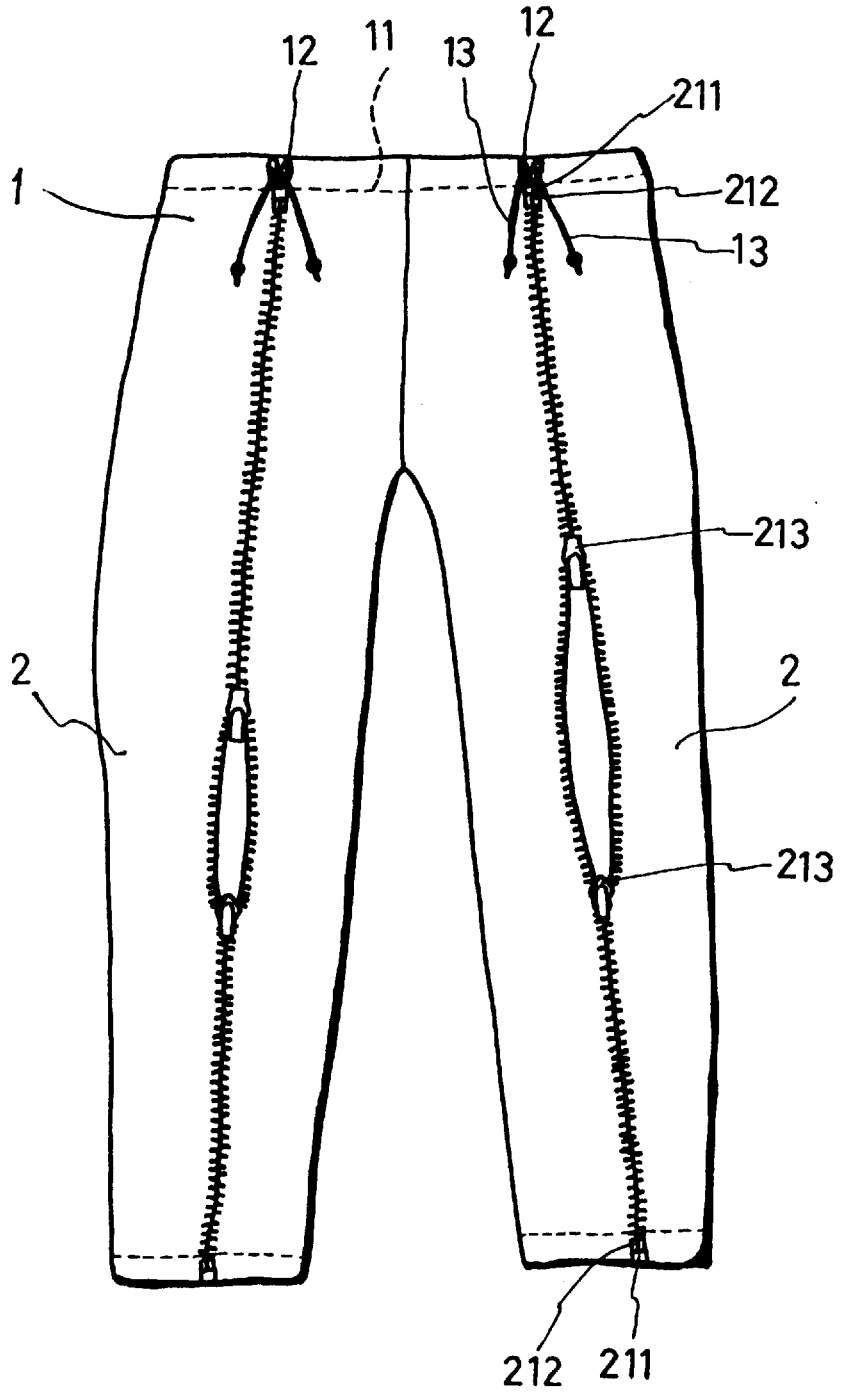
FIG. 2 is a schematic view of the trousers of the present invention with the fastening devices partially opened.
Figure 3:
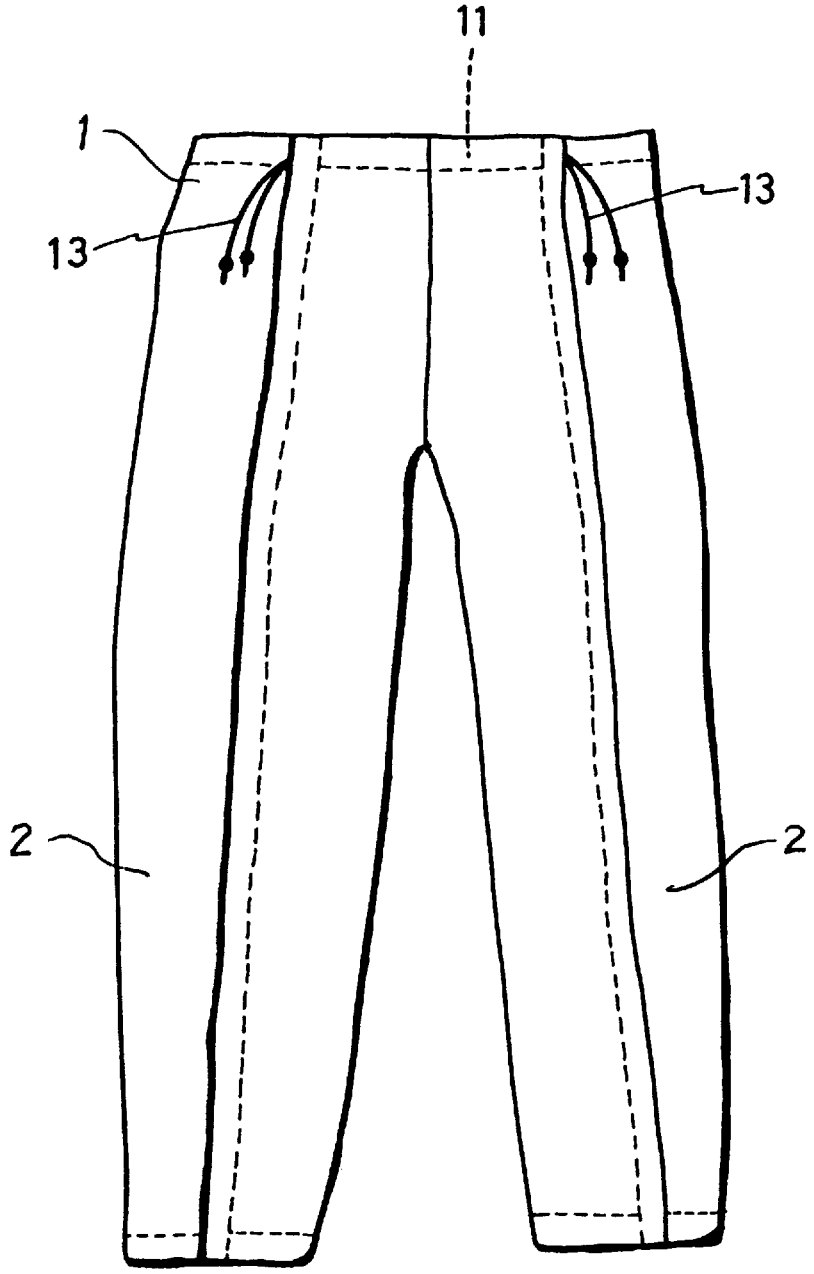
FIG. 3 is a schematic view of the trousers according to the present invention, with the fastening devices concealed by fly fronts.

With reference to FIG. 2, for a patient with knee injuries, it is only necessary to partially open the legs 2 of the trousers according to the present invention by pulling the slides 213 away from each other to suitable positions, such that an opening of a suitable size in formed in each leg 2 of the trousers of the invention to permit medical examination or treatment on the patient's knee.

In practice, known fly fronts may be provided to conceal the fastening devices 21 so that the trousers for patients according to the present invention look just like ordinary trousers.

In view of the above, it can be seen that the trousers according to the present invention is nice-looking and, particularly, facilitates medical examination or treatment on the lower limbs of patients.

Although the present invention has been illustrated and described with reference to the preferred embodiment thereof, it should be understood that it is in no way limited to the details of such embodiment but is capable of numerous modifications within the scope of the appended claims.

What is claimed is:

1. Hospital trousers for patients comprising a waist portion and a pair of legs, said waist portion being provided with tying means, wherein each of said legs has a slit formed in a front side thereof and running lengthwise from said waist portion to a bottom end of each said leg, and a fastening device provided at each slit consisting of an upper stop and an upper pawl disposed at an upper end of said fastening device, a lower stop and a lower pawl disposed at a lower end of said fastening device, and two slides disposed oppositely at both ends of said fastening device, whereby said fastening device is closed by the downward movement of the upper slide and the upward movement of the lower slide, said tying means consisting of a string hole formed by folding said waist portion inwardly having an opening formed on both sides of each slit defining a first string hole portion disposed between said slits on one side and a second string hole portion disposed between said slits on a second side, a first string arranged in said first string hole portion and a second string arranged in said second string hole portion, said first and second strings extending through said openings for tying purposes, and a fly front concealing each fastening device.

* * * * *